US005135275A

United States Patent [19]

Kettelson

[11] Patent Number: 5,135,275

[45] Date of Patent: Aug. 4, 1992

[54] BOWLING BALL CARRIER

[75] Inventor: Russell W. Kettelson, 27101 Groesbeck Hwy., Warren, Mich. 48099

[73] Assignees: Charles E. Critchley, Royal Oak; Russell W. Kettelson; Susan A. Kettelson, both of Waterford, all of Mich. ; a part interest to each

[21] Appl. No.: 573,858

[22] Filed: Aug. 28, 1990

[51] Int. Cl.[5] ..... A63B 71/00; B65G 9/00

[52] U.S. Cl. ..... 294/16; 294/146; 206/315.91

[58] Field of Search ..... 294/15, 16, 28, 142, 294/145-147, 165; 150/154; 206/315.9, 315.91; 190/117; 229/117.14; 273/37, 54 R, 54 B

[56] References Cited

U.S. PATENT DOCUMENTS

| | | | |
|---|---|---|---|
| 1,910,168 | 5/1933 | Jacobs | 294/142 |
| 2,738,976 | 3/1956 | Vallieres | 206/315.9 X |
| 2,991,859 | 7/1961 | Kaplan | 190/48 |
| 3,123,204 | 3/1964 | Baker et al. | 206/315.91 X |
| 3,266,605 | 8/1966 | Anderson et al. | 190/48 |
| 3,934,772 | 1/1976 | Brannan | 294/28 X |
| 4,055,287 | 10/1977 | Champenois, Jr. | 294/147 X |

*Primary Examiner*—Margaret A. Focarino
*Assistant Examiner*—Dean J. Kramer
*Attorney, Agent, or Firm*—Charles W. Chandler

[57] ABSTRACT

A bowling ball carrier formed by two upright facing panels hingedly connected together at their lower edges. The ball is gripped by circular flanges extending from the panels at the edges of circular holes in the panels. Upper face areas of the panels abut together to form a hand grip for the ball carrier.

22 Claims, 3 Drawing Sheets

BOWLING BALL CARRIER

BACKGROUND AND SUMMARY OF THE INVENTION

This invention relates to a carrier for a bowling ball. In a preferred form of the invention, the carrier has two upright, rigid facing panels having upper surface areas abutted together. The lower edges of the panels are interconnected by horizontal axis hinge means, such that upper portions of the panels can be spread apart for receiving a bowling ball between the panels. Each panel has a circular hole adapted to encircle a portion of a bowling ball. Edge areas of the circular holes are enabled to grip spaced surface areas of the bowling ball to firmly hold the ball within the carrier. The upper edges of the panels form a handle (hand grip) that can be used to lift and transport the ball carrier.

The panels can be similarly configured as molded plastic components. Each panel preferably has two integral hinge arms at its lower end, and multiple reinforcement flanges projecting in opposite directions from its opposite faces. Each panel further comprises two oppositely projecting ears adapted to extend into the heel portions of individual bowling shoes, whereby the shoes are individually hung (suspended) from the carrier outboard from the bowling ball. The panels are designed for manufacture as relatively low cost injection moldings.

The hinge connections between the carrier panels are configured so that when a bowling ball is deposited into the space between the panels, the weight of the ball automatically swings the panels together toward closed positions suitable for being lifted and carried as a unit. It is unnecessary to actuate any mechanical latches before lifting or transporting the carrier. The carrier is free-standing and self-supporting.

An important object of the invention is to provide a bowling ball carrier that is capable of being formed of a relatively few components. A related object is to provide a carrier that has a relatively low manufacturing cost and a relatively low total weight. The carrier is formed primarily by two similarly configured molded panel elements. Rigidifying flanges are incorporated into the panel elements such that each panel element has a relatively low total weight. The panel elements are adapted to firmly engage the bowling ball without enveloping the entire ball surface. Since only a small quantity of material is used for each panel element, it becomes feasible to use high grade (strong) plastic materials.

The carrier can be used in association with a separate flexible full fabric cover. The cover is adapted for insertion onto (over) the carrier and bowling ball, thereby protecting the ball from dirt or direct contact with other objects. Since the cover is a relatively low cost fabric item, it adds comparatively little to the overall cost of the ball carrier. The cover is an optional item that may or may not be used with the ball carrier.

Additionally, the carrier can be used in association with individual "ball" and "shoe" (bootie) covers. In this way the carrier is actually exposed, giving a different appearance than a fully covered unit. This "shoe" (bootie) cover structure requires that the carrier panels include straps to secure the shoes.

Finally, the carrier can be configured to carry two balls. Both panels, of course, would be longer and contain two ball nesting holes.

Other uses of this carrier design would be to accommodate: basketball and shoes, soccer ball and shoes, volleyball and shoes, and football and shoes.

Prior to the present invention, various types of bowling ball carriers have already been proposed. I am aware of U.S. Pat. No. 2,991,859 to A. Kaplan and U.S. Pat. No. 3,266,605 to R. Anderson, et al, which show two prior art rigid ball carriers. My present invention is believed to be a low cost alternative to the prior art structures, and offers a uniquely different bowling equipment storage arrangement.

THE DRAWINGS

DESCRIPTION OF A PREFERRED EMBODIMENT OF THE INVENTION

Figure 6:
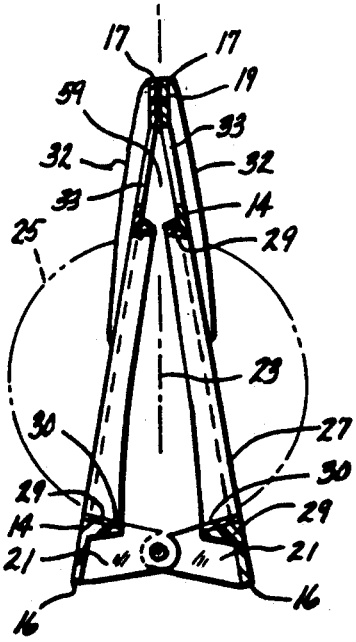
FIG. 6 is a transverse sectional view taken through the carrier shown in FIG. 4.

The drawings show a bowling ball carrier 10 and associated fabric cover 12 removably associated therewith. Carrier 10 comprises two similarly configured panels 14 arranged in upright facing relation. As seen in FIG. 6, the panels are angled to each other at an included angle of approximately twenty-five degrees so as to assume an inverted "V" configuration, with spaced lower edges 16, and adjacent upper edges 17. Surface areas 19 of the panels are abutted together in the FIG. 6 condition.

Figure 5:
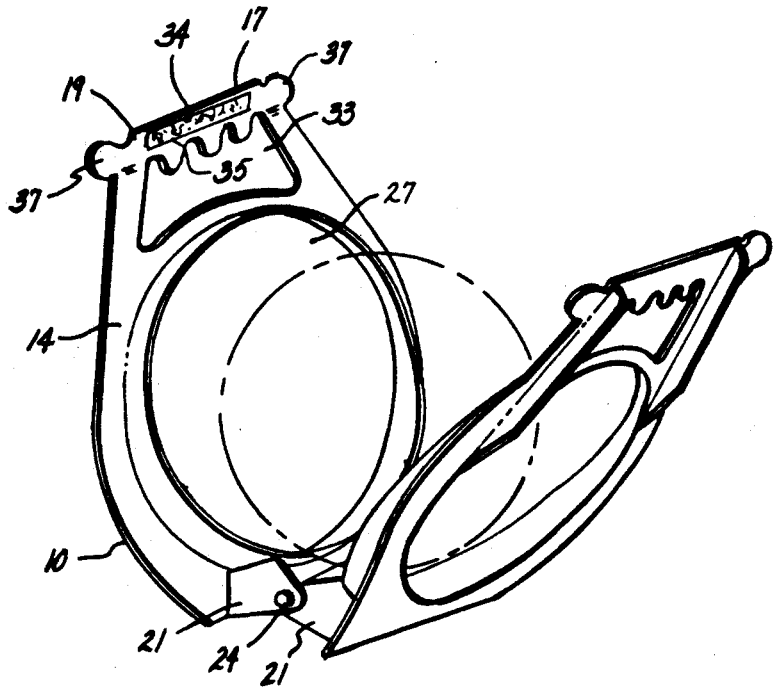
FIG. 5 is a view taken in the same direction as FIG. 3, but with the panel elements of the carrier spread apart to receive a bowling ball.

The lower end areas of the panels are hingedly interconnected by means of a horizontal axis hinge means 20 that comprises two flat flange-like arms 21 extending from each panel through the vertical midplane 23 of the carrier. Overlapped portions of the arms are hingedly connected together by rivets 24. As seen in FIG. 5, the two panels can be spread apart (around hinge 20 axis) to receive a bowling ball 25 in the space between the panels.

Each panel has a transverse circular hole 27 extending therethrough to encircle chord sections of ball 25. Each hole 27 has a diameter that is less than the ball diameter. A circular flange 29 extends along the edge of each hole 27 to form a surface 30 adapted to grip the ball 25 surface. A rubber lining may be used on each surface 30 to provide a soft, non-abrasive ball contact surface.

Each circular flange 29 serves to rigidify the associated panel. Further rigidification of each panel is provided by two essentially straight flanges 32 that extend from diametrically spaced edge areas of hole 27 generally upward to edge 17 of the panel. Flanges 29 and 32 extend from the associated panel in opposite directions, i.e., from opposite faces of the panel.

Each panel has a slot 33 in the area above circular hole 27. Edges of each slot are scalloped to accommodate the fingers of the person (bowler) during lifting and transport of the carrier. Panel areas 34 above slots 33 form a hand grip (handle) for the carrier.

The hinge axis passing through rivets 24 is located inboard from the facing panels, i.e., on the carrier midplane, such that when ball 25 is deposited into the carrier, the weight of the ball biases the panels together, as shown in FIG. 6. The hand grip elements 34 are in contact to accommodate the user's hand and fingers. The facing surfaces of elements 34 may have patches 35 of miniature interlocking fibrous materials adhered thereto. Such interlocking fibrous (hook and loop) materials are commercially available under the trademark VELCRO.

Figure 3:
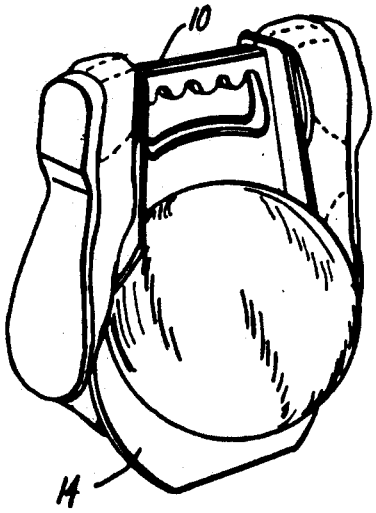
FIG. 3 is a view taken in the same direction as FIG. 1, but with the fabric cover removed from the carrier.
Figure 4:
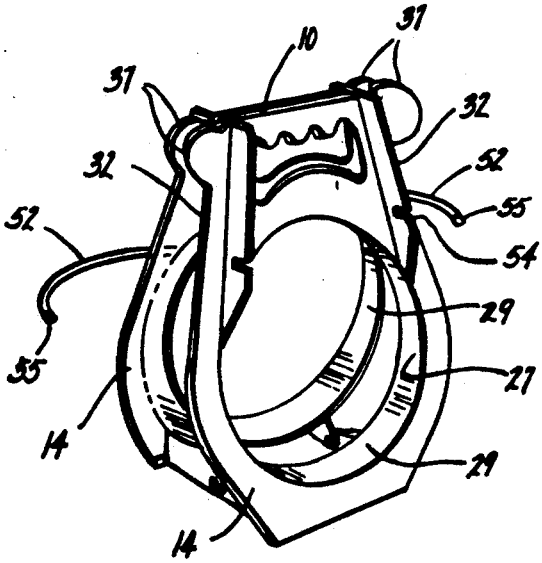
FIG. 4 is a view taken in the same direction as FIG. 3, but showing an alternative arrangement.

FIGS. 3 and 4 show two integrally formed ears 37 extending within the plane of each panel 14 at (or adjacent) the panel upper edge 17. The ears extend in opposite directions to form a hanger mechanism for a pair of bowling shoes (when the panels are abutted together as shown in FIG. 3). Each set of ears 37 extend into the heel area of the shoe to suspend the shoe outboard from ball 25. Note that the shoe's heel goes over (encloses) the ears 37 while the shoe's toe area nests in between both panels 14.

Figure 1:
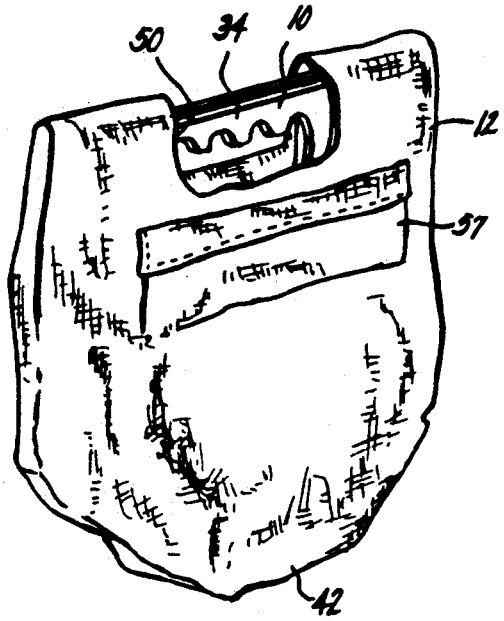
FIG. 1 is a perspective view of a bowling ball carrier and fabric cover embodying the present invention.
Figure 2:
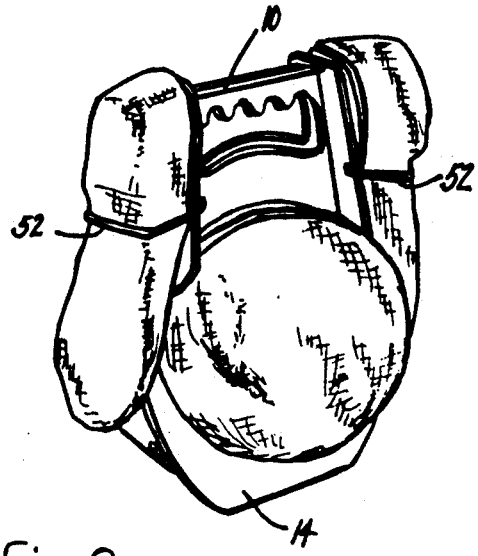
FIG. 2 is a perspective view of a bowling ball carrier and individual "ball" and "shoe" (bootie) fabric cover.
Figure 7:
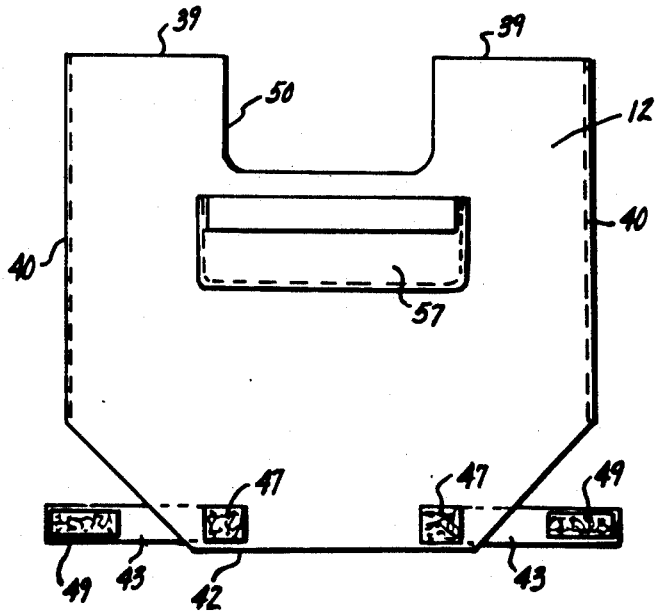
FIG. 7 is a front elevational view of a fabric cover used in the FIG. 1 assembly.

FIG. 1 shows the FIG. 3 assembly enclosed within a fabric cover 12. FIG. 7 shows the fabric cover separated from the rigid carrier. The cover can be formed of a single fabric sheet doubled back on itself along line 39, and stitched along its side edges, as at 40. The lower edges 42 of the cover are left unconnected, such that the cover has a bottomless character. The cover can thus be inserted downwardly over the carrier to enclose the bowling ball, as shown in FIG. 1.

Flexible tapes 43 are sewn to the cover rear wall at its lower edge, such that when the cover is on the carrier, the tapes can be pulled around the carrier sides to connect to adhesive patches 47 located on the front wall of the cover. Mating patches 49 are carried on the tapes for adhesive contact with patches 47. Patches 47 and 49 can be formed of the same material as patches 35. A zipper could be utilized along edge 40 instead of utilizing tapes 43, 47 and 49.

The upper portion of cover 12 has a cut-out 50 extending therethrough for registry with hand grips 34 when the cover is fully inserted onto carrier 10. Thus, the person can use the hand grips when the cover is in place on the carrier.

Cover 12 acts as a retainer to keep the bowling shoes (FIG. 3) in place on the carrier. FIG. 4 shows an alternate arrangement, wherein the shoes with or without "shoe" (bootie) covers are retained by flexible straps (cords) 52. Each cord can be pulled around a suspended shoe and into a slot 54 formed in a flange 32. An enlargement 55 on each cord prevents separation of the cord from the slot.

Figure 8:
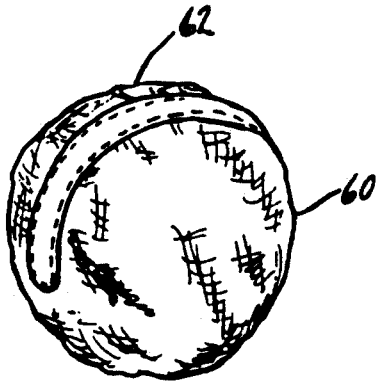
FIG. 8 is a view of an individual ball cover.

An independent ball cover is shown at 60 in FIG. 8 with 180 degrees access slit (opening) 62.

Figure 9:
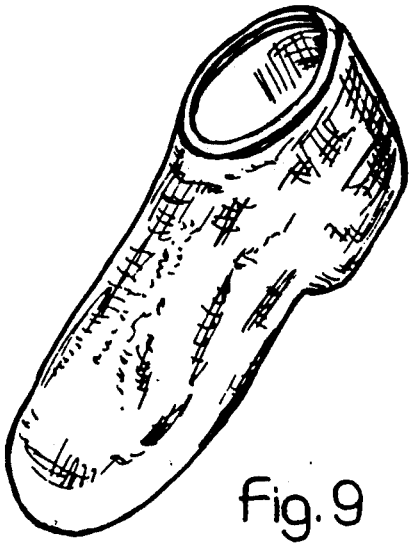
FIG. 9 is a view of a bootie.

An independent shoe (bootie) cover 64 is shown in FIG. 9 with access hole (elasticized opening) 66.

The cover structure 12 (FIGS. 1 and 7) can be provided with one or more pockets 57 for containing additional bowling equipment. Also, space 59 above the bowling ball (FIG. 6) between the two panels can be used to contain a towel in a position draped over the ball.

The principal cost items in the carrier-cover assembly are the two identical panels 14. Each panel can be formed as a molded plastic element, using the injection molding process. Each panel is a skeleton-like structure having a relatively low mass and low weight. The carrier structure is considered to be a low cost alternative to prior art bowling bags and rigid containers. Additionally, it is important to understand that panels 14 do not have to be injection molded plastic. They could be cast aluminum, or even simple metal stampings.

Figure 10:
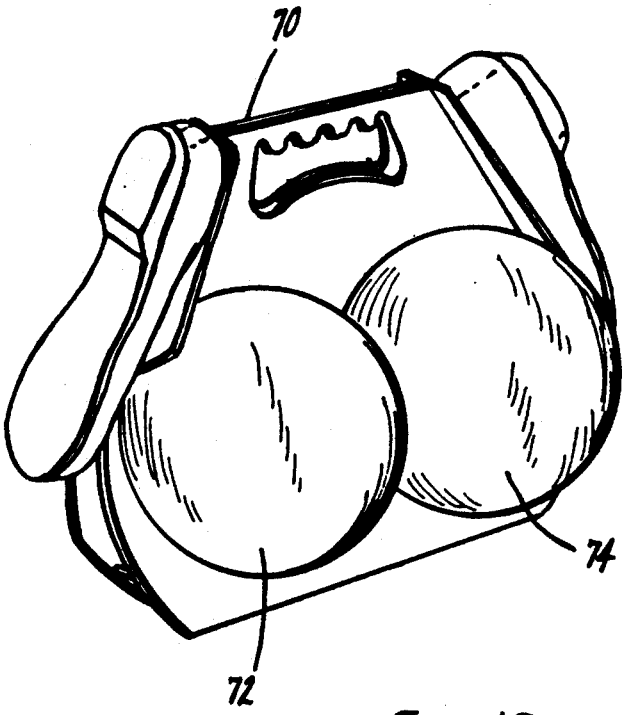
FIG. 10 is a view of a twin ball embodiment.

FIG. 10 illustrates a dual ball carrier 70 for carrying a pair of balls 72 and 74. Carrier 70 is similar to carrier 10 except that it has openings for supporting two balls.

This bowling ball carrier is unique and offers superior organization of bowling equipment and ease of access. Additionally, it has a distinctively different look and construction than all past bowling bags.

I claim:

1. A ball and shoe carrier comprising:

two upright facing panels having spaced lower edge areas and abutting upper surface areas;

hinge arms extending from each panel toward the other panel near the panel lower edges, and hinge pin means (24) extending through said hinge arms on a horizontal hinge axis located directly below the abutted upper surface areas of the panel, whereby upper portions of the panels can be spread apart for downward insertion of a spherical ball into the space between the panels;

said hinge arms and hinge pin means constituting the sole connection between the panels;

each panel having a circular hole therethrough adapted to encircle a portion of a ball, the diameter of each circular hole being less than the diameter of the ball whereby edge areas of the holes are adapted to grip the ball surface;

the space between the panels being entirely unobstructed, and the circular holes in the panels having lower arcuate edge areas thereof oriented to support the entire weight of the ball after downward insertion of the ball into the space between the panels.

2. The ball carrier of claim 1, wherein said panels have an inverted "V" configuration when their upper surface areas are abutted together.

3. The ball carrier of claim 1, and further comprising aligned slots extending through the panels adjacent their upper edges so that the abutted surface areas of the panels form lifter hand grips for the carrier; and patches of miniature interlocking fibrous materials located on said abutting surface areas for releasably retaining the panels in the upright facing relation.

4. The ball and shoe carrier of claim 1, wherein each panel has two integrally formed ears extending within the panel plane at the panel upper edge; the ears on one panel being adapted to abut against the ears on the other panel to form hanger mechanisms for bowling shoes, where the shoes enclose the ears themselves but also nest between the panels at the shoe tips.

5. The ball carrier of claim 4, and further comprising a flexible strap means extending from one of the panels below each shoe hanger ear; each flexible strap means being adapted to extend around a bowling shoe suspended from the associated ear for retaining the shoe in its suspended position.

6. The ball carrier of claim 1, wherein each panel has a slot therethrough adjacent its upper edge;

said slots being aligned so that when the panels are abutted together, upper edge areas of the panels form a lifter handle for the carrier; and, a flexible cover structure adapted to fit over the carrier to envelope the bowling ball;

said cover structure having an open bottom end for downward insertion of the cover onto the carrier;

said cover structure having a cut-out that registers with the lifter handle when the cover structure is in position on the carrier; and an alternate independent cover set adapted to individually cover the ball and the shoes.

7. The ball carrier of claim 1, wherein said panels are oriented in planes that present an inverted "V" configuration when upper surfaces of the panels are abutted together;

the "V" configuration having an included angle of approximately twenty-five degrees.

8. The ball carrier of claim 1, and further comprising an endless circular flange extending from each panel along the edge of each circular hole; each flange extending from the associated panel into the space between the panels; each flange having a side surface thereof facing the hole axis for gripping engagement with the ball surface.

9. The ball carrier of claim 1, and further comprising openings (33) extending through the panels adjacent their upper edges so that the abutting surface areas of the panels form lifter hand grips for the carrier.

10. The ball carrier of claim 1, and further comprising two additional flanges (32) extending from each panel away from the space between the panels, each additional flange extending from the edge area of an associated circular hole generally upwardly to the upper edge of the panel, whereby the upper portion of each panel is rigidified against bending or cracking.

11. A bowling ball carrier comprising:

two upright facing panels having spaced lower edge areas, and abutting upper surface areas;

a horizontal axis hinge means interconnecting said panels near their lower edges whereby upper portions of the panels can be spread apart for downward insertion of a bowling ball into the space between the panels;

each panel having a circular hole therethrough adapted to encircle a portion of a bowling ball, the diameter of each circular hole being less than the diameter of the bowling ball whereby edge areas of the holes are adapted to grip the bowling ball surface; and said horizontal axis hinge means comprising two arms extending right-angularly from each panel, said arms being arranged so that end areas of the arms on one of said panels overlap end areas of the arms on the other panel, and hinge pins extending through the overlapped areas of the arms.

12. A bowling ball shoe and towel carrier comprising:

two upright facing panels having spaced lower edge areas, and abutting upper surface areas;

a horizontal axis hinge means interconnecting said panels near their lower edges whereby upper portions of the panels can be spread apart for downward insertion of a bowling ball into the space between the panels;

each panel having a circular hole therethrough adapted to encircle a portion of a bowling ball, the diameter of each circular hole being less than the diameter of the bowling ball whereby edge areas of the holes are adapted to grip the bowling ball surface; and each panel having two integrally formed ears extending within the panel plane at the panel upper edge; the ears on one panel being adapted to abut against the ears on the other panel to form hanger mechanisms for bowling shoes, where the shoes enclose the ears themselves but also nest between the panels at the shoe tips;

flexible strap means extending from one of the panels below each shoe hanger ear; each flexible strap means being adapted to extend around a bowling shoe suspended from the associated ear for retaining the shoe in its suspended position.

13. A bowling ball shoe and towel carrier as defined in claim 12, the panels being disposed such that when abutted together, they define an opening between them for receiving a towel draped over a ball inserted between the panels.

14. A bowling ball and shoe carrier comprising:

two upright facing panels having spaced lower edge areas, and abutting upper surface areas;

a horizontal axis hinge means interconnecting said panels near their lower edges whereby upper portions of the panels can be spread apart for downward insertion of a bowling ball into the space between the panels;

each panel having a circular hole therethrough adapted to encircle a portion of a bowling ball, the diameter of each circular hole being less than the diameter of the bowling ball whereby edge areas of the holes are adapted to grip the bowling ball surface;

each panel having a slot therethrough adjacent its upper edge;

said slots being aligned so that when the panels are abutted together, upper edge areas of the panels form a lifter handle for the carrier;

a flexible cover structure adapted to fit over the carrier to envelope the bowling ball;

said cover structure having an open bottom end for downward insertion of the cover onto the carrier;

said cover structure having a cut-out that registers with the lifter handle when the cover structure is in position on the carrier; and an alternate independent cover set adapted to individually cover the ball and the shoes.

15. A bowling ball carrier comprising:

two upright facing panels having spaced lower edge areas, and abutting upper surface areas;

a horizontal axis hinge means interconnecting said panels near their lower edges whereby upper portions of the panels can be spread apart for downward insertion of a bowling ball into the space between the panels;

each panel having a circular hole therethrough adapted to encircle a portion of a bowling ball, the diameter of each circular hole being less than the diameter of the bowling ball whereby edge areas of the holes are adapted to grip the bowling ball surface;

means for rigidifying each panel;

each rigidifying means comprising a first circular flange extending from the associated panel along the edge of said circular hole, and two additional flanges extending from diametrically spaced edge areas of the circular hole generally upward to the upper edge of the panel;

each circular flange extending from the associated panel toward the midplane of the carrier; and the additional flanges extending from the associated panel away from the midplane of the carrier.

16. The ball carrier of claim 15, wherein the rigidifying flanges are formed as integral molded parts of the associated panels.

17. A bowling ball and shoe carrier comprising:

two upright facing panels having spaced lower edge areas and abutting upper surface areas;

a horizontal axis hinge means interconnecting said panels near their lower edges whereby upper portions of the panels can be spread apart for downward insertion of a bowling ball into the space between the panels;

each panel having a circular hole therethrough adapted to encircle a portion of a bowling ball, the diameter of each circular hole being less than the diameter of the bowling ball whereby edge areas of the holes are adapted to grip the bowling ball surface; and said horizontal axis hinge means comprising two arms extending right-angularly from each panel, said arms being arranged so that end areas of the arms on one of said panels overlap end areas on the other panel, and hinge pins extending through the overlapped areas of the arms.

18. A bowling ball carrier comprising:

two upright facing panels having spaced lower edge areas, and abutting upper surface areas;

a horizontal axis hinge means interconnecting said panels near their lower edges whereby upper portions of the panels can be spread apart for downward insertion of a bowling ball into the space between the panels;

each panel having a circular hole therethrough adapted to encircle a portion of a bowling ball, the diameter of each circular hole being less than the diameter of the bowling ball whereby edge areas of the holes are adapted to grip the bowling ball surface;

each panel having two integrally formed ears extending within the panel plane at the panel upper edge; the ears on one panel being adapted to abut against the ears on the other panel to form hanger mechanisms for bowling shoes, where the shoes enclose the ears themselves but also nest between the panel at the shoe tips; and a flexible strap means extending from one of the panels below each shoe hanger ear; each flexible strap means being adapted to extend around a bowling shoe suspended from the associated ear for retaining the shoe in its suspended position.

19. A bowling ball carrier, comprising:

two upright facing panels having spaced lower edge areas and abutting upper surface areas;

a horizontal axis hinge means interconnecting said panels near their lower edges whereby upper portions of the panels can be spread apart for downward insertion of a bowling ball into the space between the panels;

each panel having a circular hole therethrough adapted to encircle a portion of a bowling ball, the diameter of each circular hole being less than the diameter of the bowling ball whereby edge areas of the holes are adapted to grip the bowling ball surface;

each panel having a slot therethrough adjacent its upper edge;

said slots being aligned so that when the panels are abutted together, upper edge areas of the panels form a lifter handle for the carrier;

a flexible cover structure adapted to fit over the carrier to envelope the bowling ball;

said cover structure having an open bottom end for downward insertion of the cover onto the carrier;

said cover structure having a cut-out that registers with the lifter handle when the cover structure is in position on the carrier; and an alternate independent cover set adapted to individually cover the ball and the shoes.

20. A bowling ball carrier, comprising:

two upright facing panels having spaced lower edge areas, and abutting upper surface areas;

a horizontal axis hinge means interconnecting said panels near their lower edges whereby upper portions of the panels can be spread apart for downward insertion of a bowling ball into the space between the panels;

each panel having a circular hole therethrough adapted to encircle a aport ion of a bowling ball, the diameter of each circular hole being less than the diameter of the bowling ball whereby edge areas of the hole are adapted to grip the bowling ball surface;

means for rigidifying each panel;

each rigidifying means comprising a first circular flange extending from the associated panel along the edge of said circular hole, and two additional flanges extending from diametrically-spaced edge areas of the circular hole generally upward to the upper edge of the panel;

each circular flange extending from the associated panel toward the midplane of the carrier; and the additional flanges extending from the associated panel away from the midplane of the carrier.

21. A bowling ball carrier, comprising:

two upright facing panels having spaced lower edge areas and abutting upper surface areas;

arm means extending from each panel toward the other panel near the panel lower edges, and pivot means (24) extending through said arm means for pivotal motion of the two panels about a horizontal axis located directly below the abutting upper surface areas of the panels, whereby upper portions of the panels can be spread apart for downward insertion of a spherical bowling ball into the space between the panels;

said arm means and pivot means constituting the sole connection between the panels;

each panel having a circular hole therethrough adapted to encircle a portion of a bowling ball, the diameter of each circular hole being less than the diameter of the bowling ball whereby edge areas of the holes are adapted to grip the bowling ball surface;

the space between the panels being entirely unobstructed, and the circular holes in the panels having lower edge areas thereof oriented to support the entire weight of the bowling ball after downward insertion of the bowling ball into the space between the panels.

22. In a bowling ball carrier comprising:

two upright facing panels having spaced lower edge areas and abutting upper surface areas;

pivot means interconnecting said panels near their lower edges whereby upper portions of the panels can be spread apart from downward insertion of a bowling ball into the space between the panels;

each panel having a circular hole therethrough adapted to encircle a portion of a bowling ball, the diameter of each circular hole being less than the diameter of the bowling ball whereby edge areas of the holes are adapted to grip the bowling ball surface;

each panel having a slot therethrough adjacent its upper edge;

said slots being aligned so that when the panels are abutted together, upper edge areas of the panels form a lifter handle for the carrier, the improvement comprising:

a flexible cover structure adapted to fit over the carrier to envelope the bowling ball;

said cover structure having an open bottom end for downward insertion of the cover onto the carrier; and said cover structure having a cut-out that registers with the lifter handle when the cover structure is in position on the carrier.

* * * * *